US009966178B2

(12) United States Patent
Seo et al.

(10) Patent No.: US 9,966,178 B2
(45) Date of Patent: May 8, 2018

(54) CHIP ELECTRONIC COMPONENT AND MANUFACTURING METHOD THEREOF

(71) Applicant: Samsung Electro-Mechanics Co., Ltd., Suwon-Si (KR)

(72) Inventors: Youn-Soo Seo, Suwon-Si (KR); Myung-Sam Kang, Hwaseong (KR); Jin-Soo Kim, Seoul (KR); Young-Gwan Ko, Seoul (KR); Woon-Chul Choi, Goyang (KR); In-Seok Kim, Suwon-Si (KR); Hye-Yeon Cha, Yongin (KR)

(73) Assignee: Samsung Electro-Mechanics Co., Ltd., Suwon-si (KR)

( * ) Notice: Subject to any disclaimer, the term of this patent is extended or adjusted under 35 U.S.C. 154(b) by 103 days.

(21) Appl. No.: 15/049,639

(22) Filed: Feb. 22, 2016

(65) Prior Publication Data

US 2016/0247624 A1 Aug. 25, 2016

(30) Foreign Application Priority Data

Feb. 23, 2015 (KR) ..... 10-2015-0024991

(51) Int. Cl.

| | |
|---|---|
| ***H01F 5/00*** | (2006.01) |
| ***H01F 27/255*** | (2006.01) |
| ***H01F 17/00*** | (2006.01) |
| ***H01F 27/32*** | (2006.01) |
| ***H01F 41/04*** | (2006.01) |
| *H01F 17/04* | (2006.01) |

(52) U.S. Cl.

CPC ..... *H01F 27/255* (2013.01); *H01F 17/0013* (2013.01); *H01F 27/324* (2013.01); *H01F 41/046* (2013.01); *H01F 2017/048* (2013.01)

(58) Field of Classification Search

CPC ..... H01F 2017/0066; H01F 27/2804; H01F 17/0013; H01F 27/255; H01F 27/292

USPC ..... 336/200

See application file for complete search history.

(56) References Cited

U.S. PATENT DOCUMENTS

| | | | | |
|---|---|---|---|---|
| 6,495,019 | B1 * | 12/2002 | Filas | H01L 27/08 205/119 |
| 6,683,523 | B2 * | 1/2004 | Takashima | H01F 17/0013 336/183 |
| 6,710,694 | B2 * | 3/2004 | Matsuta | H01F 17/0013 336/200 |
| 7,518,481 | B2 * | 4/2009 | Gardner | H01F 17/0006 336/200 |
| 8,044,758 | B2 * | 10/2011 | Nakamura | B32B 18/00 29/602.1 |
| 8,601,673 | B2 * | 12/2013 | Tseng | H01F 41/046 228/175 |
| 8,797,136 | B2 * | 8/2014 | Nakajima | H01F 5/003 336/200 |

(Continued)

*Primary Examiner* — Alexander Talpalatski
*Assistant Examiner* — Joselito Baisa
(74) *Attorney, Agent, or Firm* — NSIP Law

(57) ABSTRACT

Chip electronic component and manufacturing method thereof disclosed. An example aspect provides a chip electronic component. The chip electronic component includes a magnetic body including a magnetic material, a coil part embedded in the magnetic body and formed to be connected to a first coil conductor and a second coil conductor, an insulating layer covering the first coil conductor and the second coil conductor, and a magnetic layer formed on the insulating layer.

20 Claims, 4 Drawing Sheets

I – I'

(56) References Cited

U.S. PATENT DOCUMENTS

| | | | | |
|---|---|---|---|---|
| 2007/0159287 | A1* | 7/2007 | Jung | H01F 17/0006 336/200 |
| 2007/0182519 | A1* | 8/2007 | Tsuzuki | H01F 17/0006 336/200 |
| 2008/0001699 | A1* | 1/2008 | Gardner | H01F 10/16 336/200 |
| 2008/0007380 | A1* | 1/2008 | Snyder | H01F 41/042 336/180 |
| 2013/0222101 | A1* | 8/2013 | Ito | H01F 17/04 336/83 |
| 2014/0145814 | A1* | 5/2014 | Lee | H01F 17/0013 336/200 |
| 2014/0184374 | A1* | 7/2014 | Park | H01F 27/255 336/83 |

* cited by examiner

I – I'

CHIP ELECTRONIC COMPONENT AND MANUFACTURING METHOD THEREOF

CROSS-REFERENCE TO RELATED APPLICATIONS

This application claims the benefit of Korean Patent Application No. 10-2015-0024991, filed with the Korean Intellectual Property Office on Feb. 23, 2015, the entire disclosure of which is incorporated herein by reference for all purposes.

BACKGROUND

1. Field

The present disclosure relates to a chip electronic component and manufacturing method thereof.

Generally, an inductor, a chip electronic component, is a representative passive element that configures an electronic circuit together with a resistor and a capacitor for removing noise.

Additionally, a thin layer inductor is manufactured by forming a coil part by a plating processing, forming a magnetic body by hardening a magnetic-resin compound that is a mixture of a magnetic powder and a resin, and forming an external contact on an outer surfaces of the magnetic body.

As the miniaturization of the chip electronic component has been required along with the gradual miniaturization of the electronic devices, the volume of the magnetic material and the number of turns of the coil part decrease due to the miniaturization of the chip electronic component to deteriorate the inductance and quality factor.

Despite the conventional efforts for improving the permeability by forming the magnetic body using a magnetic material having a high permeability in order to solve these problems, it has been hardly successful to achieve the target inductance and quality factor while decreasing the size of the chip electronic components due to limitations in developing materials having a high permeability.

SUMMARY

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

In a general aspect, there is provided a chip electronic component that includes a magnetic body including a magnetic material, a coil part embedded in the magnetic body and formed to be connected to a first coil conductor and a second coil conductor, an insulating layer covering the first coil conductor and the second coil conductor, and a magnetic layer formed on the insulating layer.

The magnetic layer may be formed by a plating processing.

The chip electronic component may include a plating seed layer that may be formed between the insulating layer and the magnetic layer.

The magnetic layer may include a permeability larger than that of the magnetic material in the magnetic body.

The magnetic layer may include a metal or an alloy that includes at least one selected from the group consisting of iron (Fe), silicon (Si), boron (B), chromium (Cr), aluminum (Al), copper (Cu), niobium (Nb), and nickel (Ni).

The chip electronic component may include a surface of the insulating layer that may be formed in a form to be corresponded to surfaces of the first coil conductor and the second coil conductor.

The magnetic body may include a metallic magnetic powder and a thermosetting resin.

The coil part may be formed by a plating processing.

In another aspect, there is provided a manufacturing method of a chip electronic component, the manufacturing method including forming a coil part by forming a first coil conductor and a second coil conductor, forming an insulating layer configured to cover the first coil inductor and the second coil inductor, forming a magnetic layer on the insulating layer, and forming a magnetic body by stacking a magnetic sheet including a metallic magnetic powder and a thermosetting resin on upper and lower surface of the coil part.

The magnetic layer may be formed by a plating processing.

The manufacturing method may further include forming a plating seed layer on the insulating layer before the forming the magnetic layer.

The forming the insulating layer may include forming a surface of the insulating layer in a form to be corresponded to surfaces of the first coil conductor and the second coil conductor.

The magnetic layer may include a permeability larger than that of the magnetic material in the magnetic body.

The magnetic layer may include a metal or an alloy that includes at least one selected from the group consisting of iron (Fe), silicon (Si), boron (B), chromium (Cr), aluminum (Al), copper (Cu), niobium (Nb), and nickel (Ni).

The magnetic layer may include metallic magnetic power particles having a particle size of about 0.1 μm to about 30 μm.

The chip electronic component may include the first coil conductor and the second coil conductor arranged respectively on one surface and the other surface of a substrate.

The manufacturing method may include the first coil conductor and the second coil conductor formed respectively on one surface and the other surface of a substrate.

DETAILED DESCRIPTION

The following detailed description is provided to assist the reader in gaining a comprehensive understanding of the methods, apparatuses, and/or systems described herein. However, after an understanding of the present disclosure, various changes, modifications, and equivalents of the methods, apparatuses, and/or systems described herein will be apparent to one of ordinary skill in the art. The sequences of operations described herein are merely examples, and are not limited to those set forth herein, but may be changed as will be apparent to one of ordinary skill in the art, with the exception of operations necessarily occurring in a certain order. Also, descriptions of functions and constructions that may be well known to one of ordinary skill in the art may be omitted for increased clarity and conciseness.

The terms used in the description are intended to describe certain aspects only, and shall by no means restrict the present invention. Unless clearly used otherwise, expressions in a singular form include a meaning of a plural form. In the present description, an expression such as "comprising" or "including" is intended to designate a characteristic, a number, a step, an operation, an element, a part or combinations thereof, and shall not be construed to preclude any presence or possibility of one or more other characteristics, numbers, steps, operations, elements, parts or combinations thereof.

Chip Electronic Component

Hereinafter, a chip electronic component according to an example aspect, and in particular a thin layer inductor, will be described. However, the invention is not limited thereto.

Figure 1:
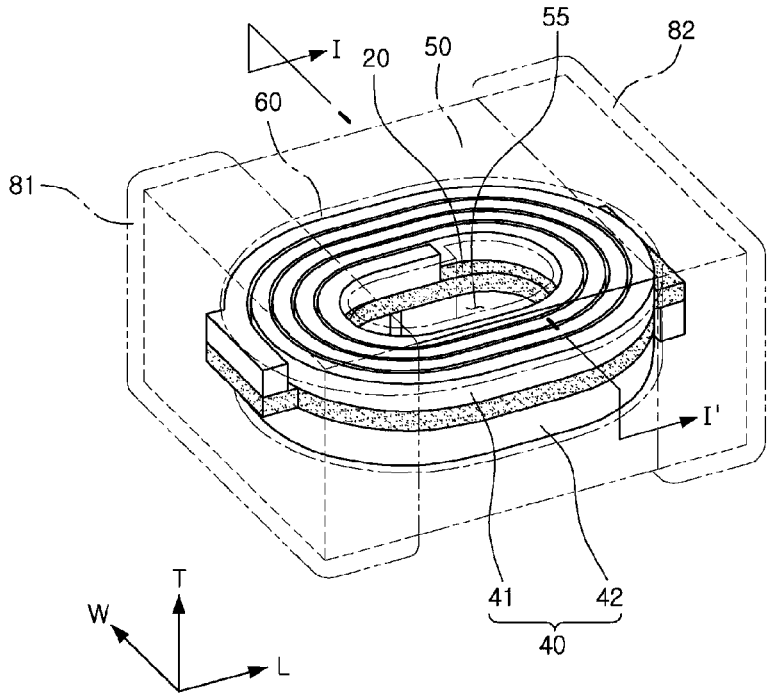
FIG. 1 is a schematic perspective view of a coil part of a chip electronic component according to an example aspect.

FIG. 1 is a schematic perspective view of a coil part of a chip electronic component according to an example aspect.

Referring to FIG. 1, a thin layer power inductor used for a power line of a power supply circuit is exemplified as a chip electronic component, by way of example.

The chip electronic component 100 according to an example aspect may include a magnetic body 50, a coil part 40 that is embedded inside of the magnetic body 50 The chip electronic component 100 may also include a first external contact 81, and a second external contact 82 that are arranged on the outer surfaces of the magnetic body 50 and electrically connected to the coil part 40.

In the chip electronic component 100 according to an example aspect, L, W and T in FIG. 1 refer to a length direction (L), a width direction (W), and a thickness direction (T).

The magnetic body 50 may include any magnetic material that exhibits magnetic properties, for example, a ferrite or a metallic magnetic powder.

The coil part 40 may be formed by coupling a first coil conductor 41 that is formed on one surface of a substrate 20 arranged inside of the magnetic body 50 to a second coil conductor 42 that is formed on the other surface that faces the one surface of the substrate 20.

Each of the first coil conductors 41 and the second coil conductors 42 may have a planar coil shape that is formed on same surface of the substrate 20. Alternatively, the first coil conductor 41 and the second coil conductor 42 may have a spiral shape.

One end portion of the first coil conductor 41 may be extended and led-out to one end surface in the length direction L of the magnetic body 50, and one end portion of the second coil conductor 42 may be extend and led-out to the other end surface in the length direction L of the magnetic body 50.

The first coil conductors 41 and the second coil conductors 42 may be formed, but not limited to, by performing an electroplating processing on the substrate.

The substrate 20 may be a PolyPropylene Glycol (PPG) substrate, a ferrite substrate, a metal based soft magnetic substrate, or other such similar materials.

The substrate 20 may have a through hole formed in a central portion thereof. The through hole may be filled with a magnetic material to form a core part 55. The core part 55 may be filled with the magnetic material that may increase an inductance L.

The ends of the first coil conductors 41 and the second coil conductors 42 that are led-out to each of end surfaces in the length direction L of the magnetic body 50 are electrically connected, respectively, to the first external contact 81 and the second external contact 82. The first external contact 81 and the second external contact 82 are arranged on each of end surfaces in the length direction L of the magnetic body 50.

In addition, a magnetic layer 60 may be formed on the coil part 40 of the chip electronic component 100 according to an example aspect. The magnetic layer 60 according to the example aspect will be described in detail below.

Figure 2:
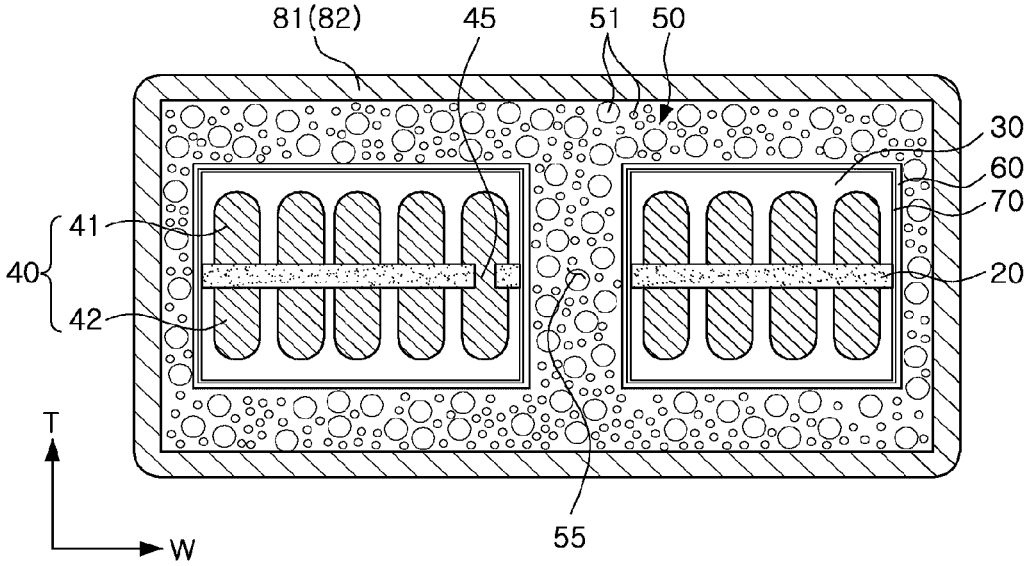
FIG. 2 is a cross-sectional view taken along line I-I' of FIG. 1.

FIG. 2 is a cross-sectional view taken along line I-I' of FIG. 1.

Referring to FIG. 2, the magnetic body 50 according to an example aspect may include a metallic magnetic powder 51.

The metallic magnetic powder 51 may be a crystalline or amorphous metal or an alloy that includes at least one selected from the group consisting of iron (Fe), silicon (Si), boron (B), chromium (Cr), copper (Cu), aluminum (Al), niobium (Nb), and nickel (Ni). For example, the metallic magnetic powder 51 may be, but not limited to, Fe—Si—Cr based amorphous metal.

The metallic magnetic powder 51 may have a particle size of about 0.1 μm to about 30 μm, and may have more than two metallic magnetic powders with different average particle sizes. By mixing two metallic magnetic powders with different average particle sizes, the density may be increased so that high permeability can be secured and to prevent a deterioration in efficiency thereof due to core loss even under high frequency and high current condition.

The metallic magnetic powder 51 may be dispersed in a thermosetting resin such as epoxy resin, polyimide, or other such similar materials.

The first coil conductors 41 and the second coil conductors 42 that are formed on one surface and the other surface of the substrate 20 are connected to each other through a via 45. Via 45 also penetrates through the substrate 20 to form the coil part 40.

The first coil conductor 41, the second coil conductor 42, and the via 45 may be formed of a metal having excellent electrical conductivity, and may be, for example, formed of silver (Ag), palladium (Pd), aluminum (Al), nickel (Ni), titanium (Ti), gold (Au), copper (Cu), platinum (Pt) or an alloy thereof.

The first coil conductor 41 and the second coil conductor 42 may be covered with an insulating layer 30.

The first coil conductor 41 and the second coil conductor 42 may be coated with the insulating layer 30 to prevent direct contact with the magnetic material of the magnetic body 50 and to prevent a short-circuit defect.

The insulating layer 30 may include, but not limited to, for example, polymer such as epoxy resin, polyimide resin, photoresist (PR), metallic oxide, among other such materials. Insulating layer 30 may include any insulating material that is capable of surrounding the first coil conductors 41 and the second coil conductors 42 to prevent the short-circuit defect.

The chip electronic component 100 according to an example aspect may include the magnetic layer 60 that is formed on the insulating layer 30.

The magnetic layer 60 may be formed of a soft magnetic material with a high permeability and may be, for example, formed of a metal or an alloy that includes at least one selected from the group consisting of iron (Fe), silicon (Si), boron (B), chromium (Cr), aluminum (Al), copper (Cu), niobium (Nb), and nickel (Ni).

The magnetic layer 60 may have a permeability larger than that of the magnetic material in the magnetic body 50.

The magnetic layer 60 may be formed, but not limited to, by performing an electroplating processing on the insulating layer 30.

The magnetic layer 60 may be formed on the insulating layer 30 that covers the coil part 40 to increase the permeability and to implement high inductance and excellent quality factor.

As stated above, as the miniaturization of the chip electronic component has been required along with the gradual miniaturization of the electronic devices, the volume of the magnetic material and the number of turns of the coil part decrease due to the miniaturization of the chip electronic component to deteriorate the inductance and quality factor.

Despite the conventional efforts for improving the permeability by forming the magnetic body using a magnetic material having a high permeability in order to solve these problems, it has been hardly successful to achieve the target inductance and quality factor while decreasing the size of the chip electronic components due to limitations in developing materials having a high permeability.

But, in the example aspect, by forming the magnetic layer 60 with high permeability on the insulating layer 30 that covers the coil part 40, the entire permeability may be increased without increasing the permeability of the magnetic material that is included in the magnetic body 50.

The example aspect may implement high inductance L without increasing the number of turns of the coil part by forming the magnetic layer 60 on the insulating layer 30 that covers the coil part 40, increase the permeability, and reduce the number of coil turns to increase volume of the magnetic material so that the quality factor Q may be increased.

When a current is applied to the coil part 40, a magnetic flux is generated. Since the magnetic flux is formed in high density in region near the coil part 40, it may be possible to efficiently increase inductance and quality factor by forming the magnetic layer 60 with high permeability to be near the coil part 40 on the insulating layer 30 that covers the coil part 40.

Preferably, the magnetic layer 60 may be formed on the insulating layer 30 that covers the coil part 40. In case that the magnetic layer 60 is formed directly on the coil part, the short-circuit defect may occur and there may be no effect to increase inductance.

A plating seed layer 70 may be formed between the insulating layer 30 and the magnetic layer 60. The plating seed layer 70 works as a seed for electroplating to form the magnetic layer 60 on the insulating layer 30 and may include a material having excellent electrical conductivity, for example, copper (Cu). The plating seed layer 70 may be formed, but not limited to, by a thin film processing such as electroless plating, sputtering, among others.

An insulating cover layer (not shown) may be further formed on the magnetic layer 60. By forming the insulating cover layer, the short-circuit defect due to the magnetic layer 60 and the magnetic material in the magnetic body 50 can be prevented.

As shown in FIG. 2, although the magnetic layer 60 may be formed to cover the insulating layer 30 and side surfaces of the substrate entirely. This, however, is an example only, and the magnetic layer 60 may be formed on at least a portion of the insulating layer 30 that covers the coil part 40.

Figure 3:
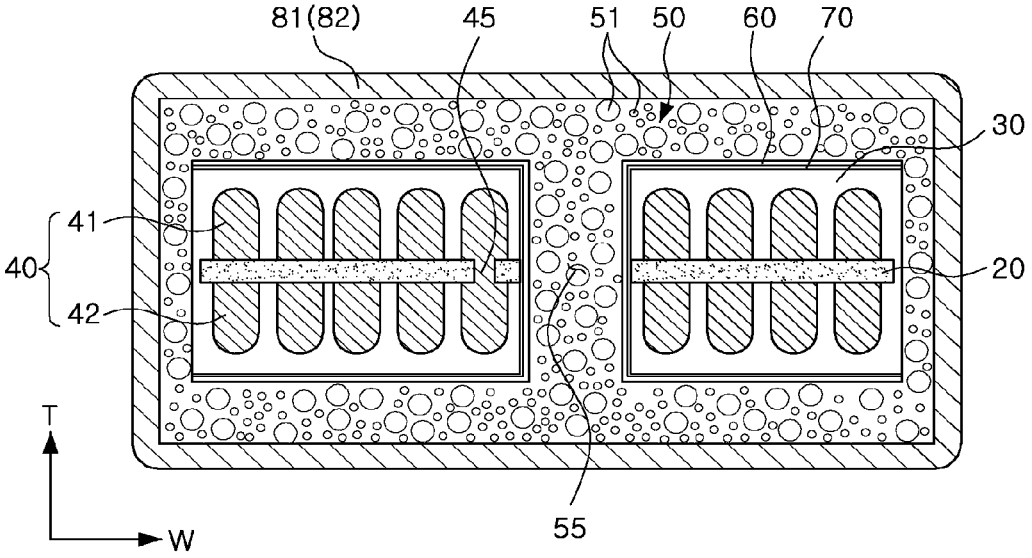
FIG. 3 is a cross-sectional view of a chip electronic component according to another example aspect in a width-thickness (W-T) direction.

FIG. 3 is a cross-sectional view of a chip electronic component according to another example aspect in a width-thickness (W-T) direction.

Referring to FIG. 3, the magnetic layer 60 of the chip electronic component 100 according to another example aspect is not formed on the outer side surfaces of the insulating layer 30. It is not needed that the magnetic layer 60 should be formed on all surfaces of the insulating layer 30. Alternatively, the magnetic layer 60 may be formed on at least a portion of the insulating layer 30.

Since the magnetic flux that is generated when a current is applied to the coil part 40 is formed in higher density in the core part 55 than outer side surfaces of the coil part 40, it may be possible to efficiently increase inductance and quality factor by forming the magnetic layer 60 with high permeability to be near the core part 55 on the insulating layer 30.

Other than the shape of the magnetic layer 60 shown in FIG. 3, all elements redundant with the chip electronic component according to an example aspect may be applied in a similar manner as with respect to the description of FIG. 2.

FIG. 3 is a cross-sectional view of a chip electronic component according to another example aspect in a width-thickness (W-T) direction.

Figure 4:
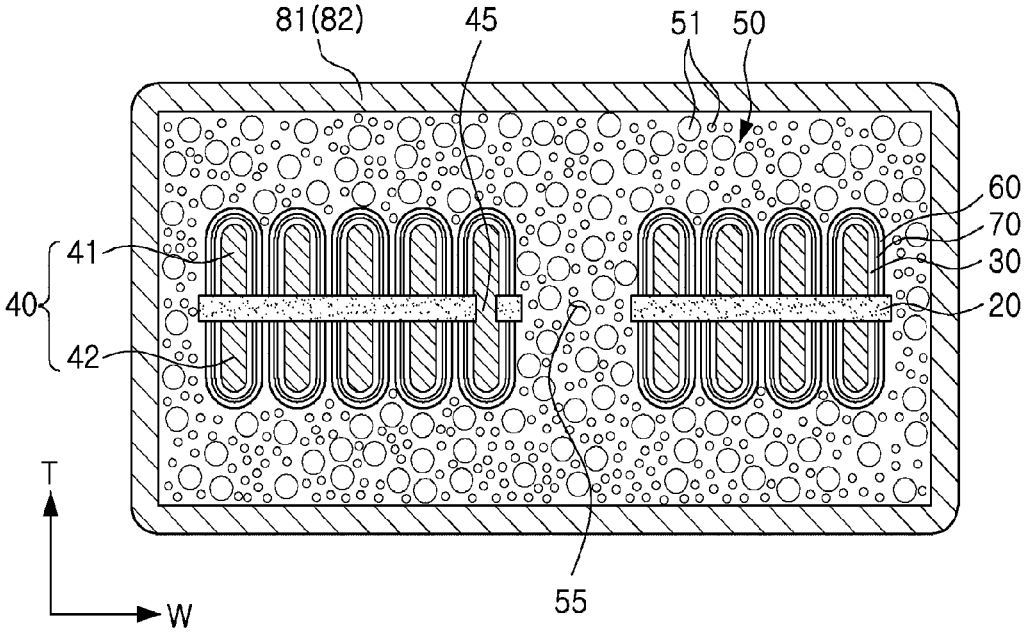
FIG. 4 is a cross-sectional view of a chip electronic component according to another example aspect in a width-thickness (W-T) direction.

Referring to FIG. 4, the surface of the insulating layer 30 according to another example aspect may be formed in the shape that corresponds to surfaces of the first coil conductors 41 and the second coil conductors 42. In order to form the insulating layer 30 to correspond to the first coil conductors 41 and the second coil conductors 42, the insulating layer 30 is thinly coated on the surfaces of the first coil conductors 41 and the second coil conductors 42, as shown in FIG. 4.

The magnetic layer 60 may be formed to correspond to the shape of the insulating layer 30 that is formed to correspond to the shape of the first coil conductors 41 and the second coil conductors 42.

A plating seed layer 70 may be further formed between the insulating layer 30 and the magnetic layer 60 to correspond to the shape of the insulating layer 30.

As shown in FIG. 4, in case the insulating layer 30 and the magnetic layer 60 are formed to correspond to the shape of the first coil conductors 41 and the second coil conductors 42, the generation of the leakage current and the waveform defect may be prevented and inductance characteristics may increase.

Other than the shapes of the insulating layer 30 and the magnetic layer 60 shown in FIG. 4, all elements redundant with the chip electronic component according to an example aspect may be applied in the same way.

Manufacturing Method of Chip Electronic Component

FIGS. 5A, 5B, 5C, 5D, 5E, and 5F are views schematically describing a manufacturing method of the chip electronic component according to an example aspect.

Figure 5A:
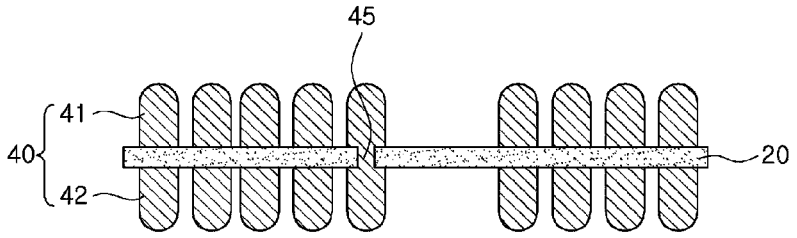
FIGS. 5A, 5B, 5C, 5D, 5E and 5F are views schematically describing a manufacturing method of the chip electronic component according to an example aspect.

Referring to FIG. 5A, the coil part 40 is formed.

After a via hole (not shown) is formed in the substrate 20 and a plating resist (not shown) having an opening is formed on the substrate 20, the first and the second coil conductors 41 and 42 and the via 45 that connects the first and the second coil conductors 41 and 42 may be formed by filling the via hole and the opening with a conductive metal by a plating processing.

The first and the second coil conductors 41 and 42 and the via 45 may be formed of a metal having excellent electrical conductivity, and may be, for example, formed of silver (Ag), palladium (Pd), aluminum (Al), nickel (Ni), titanium (Ti), gold (Au), copper (Cu), platinum (Pt) or an alloy thereof.

The method of forming the coil part 40 should not be limited to this plating processing, but the coil part 40 may be formed with a metallic wire or have any suitable shapes that can be formed inside of the magnetic body and generate a magnetic flux by a current that is applied thereto.

Figure 5B:
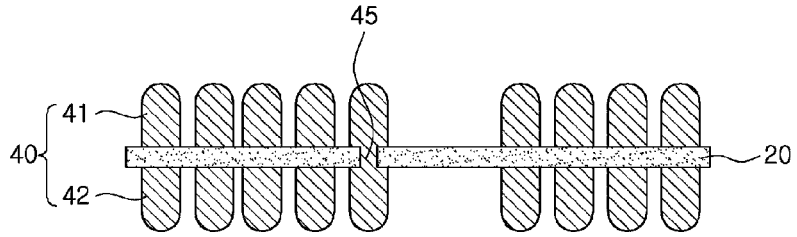

Referring to FIG. 5B, the insulating layer 30 that covers the first and the second coil conductors 41 and 42 is formed.

The insulating layer 30 may include, but not limited to, for example, polymer such as epoxy resin, polyimide resin, or the like, photoresist (PR), metallic oxide, or the like, and may include any insulating materials that are capable of surrounding the first and the second coil conductors 41 and 42 to prevent the short-circuit defect.

The insulating layer 30 may be formed by a method such as a screen printing method, an exposure and development method of a photoresist (PR), a spraying method, an oxidation method by chemical etching of coil conductor, or the like.

Alternatively, the insulating layer 30 may be formed by a chemical vapor deposition (CVD) method or a dipping method using a low viscosity polymer coating solution, and the insulating layer 30 that is formed by any of these methods can be thinly coated on the surfaces of the first and the second coil conductors 41 and 42.

Figure 5C:
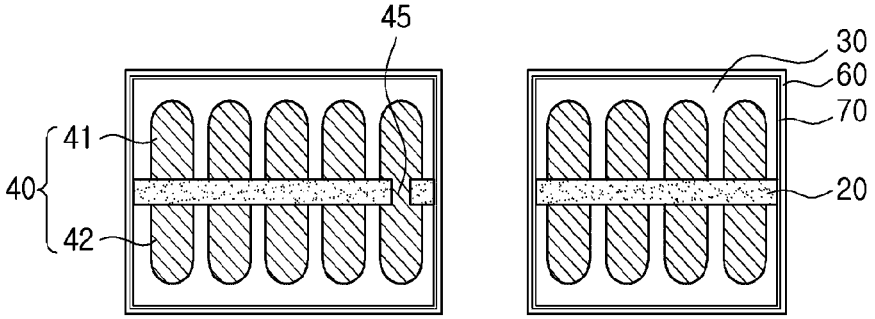

Referring to FIG. 5C, a core hole 55' may be formed by removing the central portion of the substrate 20, in which the first and the second coil conductors 41 and 42 are not formed, and the insulating layer 30. The removal of the central portion of the substrate 20 and the insulating layer 30 may be performed by a mechanical drilling, a laser drilling, a sand blasting, a punching, or other such similar drilling technique.

Figure 5D:
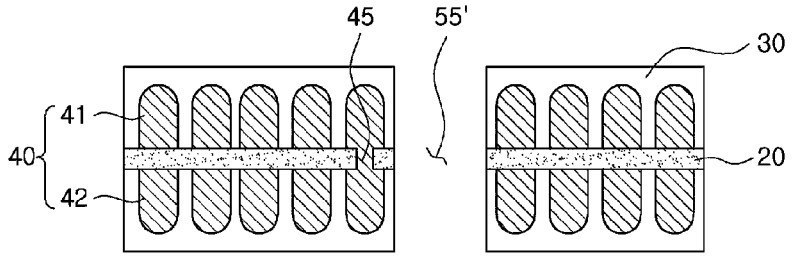

Referring to FIG. 5D, the plating seed layer 70 is formed on the insulating layer 30.

The plating seed layer 70 works as a seed for electroplating to form the magnetic layer 60 on the insulating layer 30 and may include a material having excellent electrical conductivity, for example, copper (Cu). The plating seed layer 70 may be formed, but not limited to, by a thin film processing such as electroless plating, sputtering, among others.

Figure 5E:
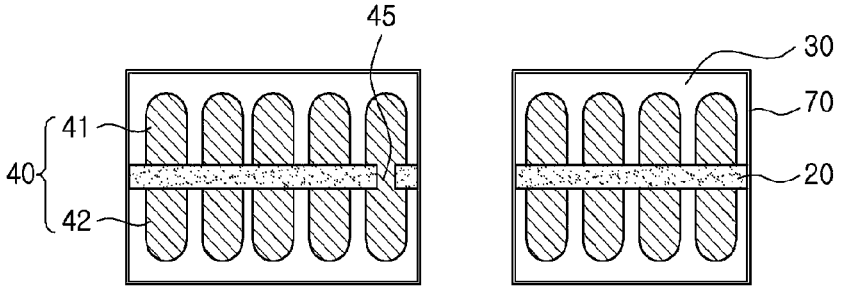

Referring to FIG. 5E, the magnetic layer 60 is formed on the plating seed layer 70.

The magnetic layer 60 may be formed of a soft magnetic material with high permeability and may be, for example, formed of a metal or an alloy that includes at least one selected from the group consisting of iron (Fe), silicon (Si), boron (B), chromium (Cr), aluminum (Al), copper (Cu), niobium (Nb), and nickel (Ni).

The magnetic layer 60 may have a permeability larger than that of the magnetic material in the magnetic body 50.

The magnetic layer 60 may be formed, but not limited to, by performing the electroplating processing on the insulating layer 30 based on the plating seed layer 70.

The magnetic layer 60 may be formed on the insulating layer 60 that covers the coil part 40 to increase the permeability and implement high inductance and excellent quality factor.

An insulating cover layer (not shown) may be further formed on the magnetic layer 60. By forming the insulating cover layer, the short-circuit defect due to the magnetic layer 60 and the magnetic material in the magnetic body 50 can be prevented.

Figure 5F:
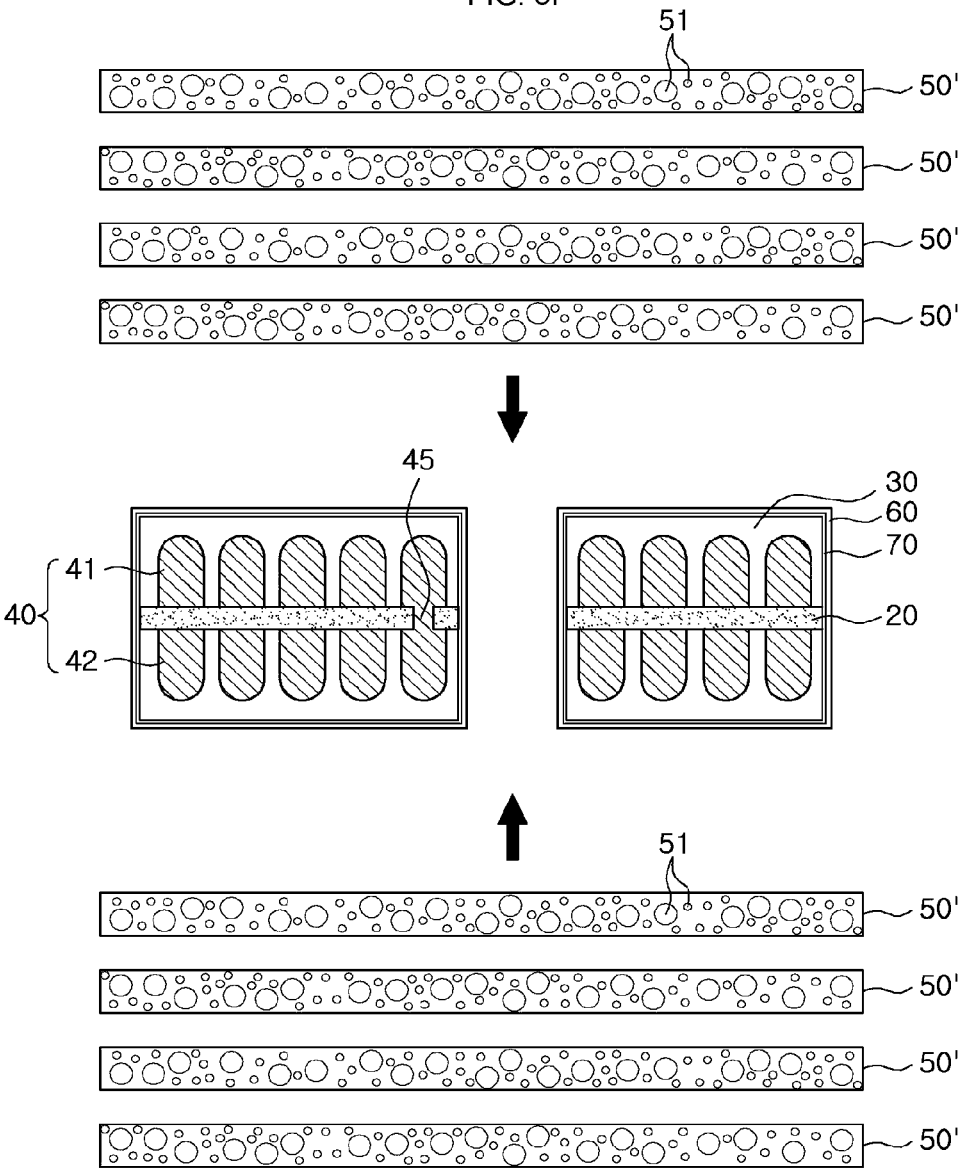

Referring to FIG. 5F, the magnetic body 50 is formed by stacking the magnetic sheets 50' having the metallic magnetic powder 51 above and below the first and the second coil conductors 41 and 42.

The magnetic sheets 50' may be manufactured in the sheet shape by mixing the metallic magnetic powder 51, the thermosetting resin, a binder, and a solvent to manufacture a slurry, by applying the slurry to a carrier film to a thickness of several tens gin by using a doctor blade, and then by drying the applied slurry.

The magnetic sheets 50' have the metallic magnetic powder 51 that is dispersed in the thermosetting resin such as epoxy resin, polyimide, or other such similar materials.

The magnetic body in which the coil part 40 is embedded 50 is formed by stacking, compressing and hardening the magnetic sheets 50'.

The core hole 55' is filled with the magnetic material to form a core part 55.

Although the processing of forming the magnetic body 50 in which the coil part 40 is embedded by stacking the magnetic sheets 50' as a method of manufacturing the chip electronic component according to an example aspect, the method may not be limited the aforementioned processing but any suitable method that is capable of forming a magnetic-resin compound in which the coil part is embedded may be applied.

Next, the first and the second external contacts 81 and 82 are formed on the outer surfaces of the magnetic body 50 to be connected to the coil part 40.

A description of features that are the same as those of the chip electronic component according to the previous example aspect will be omitted.

While this disclosure includes specific examples, it will be apparent to one of ordinary skill in the art that various changes in form and details may be made in these examples without departing from the spirit and scope of the claims and their equivalents. The examples described herein are to be considered in a descriptive sense only, and not for purposes of limitation. Descriptions of features or aspects in each example are to be considered as being applicable to similar features or aspects in other examples. Suitable results may be achieved if the described techniques are performed in a different order, and/or if components in a described system, architecture, device, or circuit are combined in a different manner and/or replaced or supplemented by other components or their equivalents. Therefore, the scope of the disclosure is defined not by the detailed description, but by the claims and their equivalents, and all variations within the scope of the claims and their equivalents are to be construed as being included in the disclosure.

What is claimed is:

1. A chip electronic component, comprising:

a magnetic body including a magnetic material;

a coil part embedded in the magnetic body and formed to be connected to a first coil conductor and a second coil conductor;

an insulating layer covering the first coil conductor and the second coil conductor; and a magnetic layer formed on the insulating layer, wherein the magnetic layer has a higher permeability in a central region of the coil part compared to a permeability in an outer region of the coil part.

2. The chip electronic component of claim 1, wherein the magnetic layer is formed by a plating processing.

3. The chip electronic component of claim 1, wherein a plating seed layer is further formed between the insulating layer and the magnetic layer.

4. The chip electronic component of claim 1, wherein the magnetic layer has a permeability larger than that of the magnetic material in the magnetic body.

5. The chip electronic component of claim 1, wherein the magnetic layer is a metal or an alloy that includes at least one selected from the group consisting of iron (Fe), silicon (Si), boron (B), chromium (Cr), aluminum (Al), copper (Cu), niobium (Nb), and nickel (Ni).

6. The chip electronic component of claim 1, wherein a surface of the insulating layer is formed in a form to be corresponded to surfaces of the first coil conductor and the second coil conductor.

7. The chip electronic component of claim 1, wherein the magnetic body comprises a metallic magnetic powder and a thermosetting resin.

8. The chip electronic component of claim 1, wherein the coil part is formed by a plating processing.

9. The chip electronic component of claim 1, wherein the magnetic layer is comprised of metallic magnetic power particles having a particle size of about 0.1 μm to about 30 μm.

10. The chip electronic component of claim 1, wherein the first coil conductor and the second coil conductor are arranged respectively on one surface and the other surface of a substrate.

11. The chip electronic component of claim 1, further comprising a through hole penetrating the insulating layer, wherein the magnetic layer is formed on a surface of the insulating layer including an inner wall of the through hole, and the magnetic material is formed on the insulating layer and in the through hole to embed the insulating layer.

12. The chip electronic component of claim 1, wherein the magnetic body comprises two metallic magnetic powers having different average particle sizes.

13. The chip electronic component of claim 1, further comprising an insulating cover layer surrounding the magnetic layer.

14. A manufacturing method of a chip electronic component, the manufacturing method comprising:

forming a coil part by forming a first coil conductor and a second coil conductor;

forming an insulating layer configured to cover the first coil inductor and the second coil inductor;

forming a magnetic layer on the insulating layer having a higher permeability in a central region of the coil part compared to a permeability in an outer region of the coil part; and forming a magnetic body by stacking a magnetic sheet including a metallic magnetic powder and a thermosetting resin on upper and lower surface of the coil part.

15. The manufacturing method of claim 14, wherein the magnetic layer is formed by a plating processing.

16. The manufacturing method of claim 14 further comprising forming a plating seed layer on the insulating layer before the forming the magnetic layer.

17. The manufacturing method of claim 14, wherein the forming the insulating layer is forming a surface of the insulating layer in a form to be corresponded to surfaces of the first coil conductor and the second coil conductor.

18. The manufacturing method of claim 14, wherein the magnetic layer has a permeability larger than that of the magnetic material in the magnetic body.

19. The manufacturing method of claim 14, wherein the magnetic layer is a metal or an alloy that includes at least one selected from the group consisting of iron (Fe), silicon (Si), boron (B), chromium (Cr), aluminum (Al), copper (Cu), niobium (Nb), and nickel (Ni).

20. The manufacturing method of claim 14, wherein the first coil conductor and the second coil conductor are formed respectively on one surface and the other surface of a substrate.

* * * * *